US009184004B2

(12) United States Patent
Gentsch

(10) Patent No.: US 9,184,004 B2
(45) Date of Patent: Nov. 10, 2015

(54) SWITCHGEAR WITH SWITCHING DEVICE DRIVEN BY PROPELLANT CHARGE

(71) Applicant: ABB Technology AG, Zürich (CH)

(72) Inventor: Dietmar Gentsch, Ratingen (DE)

(73) Assignee: ABB TECHNOLOGY AG, Zurich (CH)

( * ) Notice: Subject to any disclaimer, the term of this patent is extended or adjusted under 35 U.S.C. 154(b) by 174 days.

(21) Appl. No.: 13/757,586

(22) Filed: Feb. 1, 2013

(65) Prior Publication Data

US 2013/0194707 A1 Aug. 1, 2013

(30) Foreign Application Priority Data

Feb. 1, 2012 (EP) ..... 12000638

(51) Int. Cl.
*H01H 39/00* (2006.01)
*H01H 9/54* (2006.01)

(52) U.S. Cl.
CPC ..... *H01H 39/00* (2013.01); *H01H 9/54* (2013.01); *H01H 39/004* (2013.01); *H01H 2009/545* (2013.01)

(58) Field of Classification Search
CPC ..... H01H 39/00; H01H 9/50; H01H 39/04; H01H 9/54
See application file for complete search history.

(56) References Cited

U.S. PATENT DOCUMENTS

| | | | | |
|---|---|---|---|---|
| 4,234,901 | A * | 11/1980 | Strickland, Jr. | 361/64 |
| 4,672,174 | A * | 6/1987 | Kondo | 219/130.01 |
| 6,198,611 | B1 * | 3/2001 | Macbeth | 361/42 |
| 6,657,150 | B1 * | 12/2003 | Shea et al. | 218/154 |
| 7,095,598 | B2 * | 8/2006 | Scott et al. | 361/85 |
| 8,390,966 | B2 * | 3/2013 | Dahl et al. | 361/42 |

FOREIGN PATENT DOCUMENTS

FR 1 434 214 S 4/1966

OTHER PUBLICATIONS

European Search Report for EP 12000638 dated Jun. 13, 2012.

* cited by examiner

*Primary Examiner* — Zeev V Kitov
(74) *Attorney, Agent, or Firm* — Buchanan Ingersoll & Rooney PC

(57) ABSTRACT

A switchgear includes a switching device, which is driven by a propellant chemical charge or fast acting switch. The switchgear includes a current or fault current detection unit, and an optical sensor unit for light arc or fault light arc detection, without the need of having an auxiliary voltage applied. In order to reduce the closing time of an earthing switch, the electrical circuit of an inductive current detection unit is electrically connected in series with a light sensing switching path, and a current signal directly ignites the propellant chemical charge or fast acting switch by using a limited electronic device.

17 Claims, 2 Drawing Sheets

SWITCHGEAR WITH SWITCHING DEVICE DRIVEN BY PROPELLANT CHARGE

RELATED APPLICATION

This application claims priority under 35 U.S.C. §119 to European Patent Application 12000638.2 filed in Europe on Feb. 1, 2012, the entire content of which is hereby incorporated by reference in its entirety.

FIELD

The present disclosure relates to a switchgear including a switching device, which is driven by a propellant chemical charge or fast acting switch, means for current or fault current detection, and optical sensor means for light arc or fault light arc detection.

BACKGROUND INFORMATION

Medium voltage switchgears with propellant chemical charge drives are in use for very fast earthing switches.

An example is disclosed in EP 09011839.9. A propellant chemical charge is used to drive a medium voltage switchgear. The propellant chemical charge is ignited by a fuze cable.

Actuators for fast earthing switches have to be extremely fast, in order to prevent further damage caused by the occurrence of a light arc.

SUMMARY

An exemplary embodiment of the present disclosure provides a switchgear including a switching device, which is configured to be driven by at least one of a propellant chemical charge and a fast acting switch. The exemplary switchgear also includes detection means for detecting at least one of current and fault current. In addition, the exemplary switchgear includes optical sensor means including a light sensing switch having a light sensing switching path for detecting at least one of a light arc and fault light. Furthermore, the exemplary switchgear includes an inductive current detection means having an electrical circuit being electrically connected in series with the light sensing switching path of the optical sensor means. The electrical circuit is configured to generate a current signal to directly ignite the at least one of the propellant chemical charge and fast acting switch.

BRIEF DESCRIPTION OF THE DRAWINGS

Additional refinements, advantages and features of the present disclosure are described in more detail below with reference to exemplary embodiments illustrated in the drawings, in which.

Unless otherwise indicated, identical or similarly functioning components of the exemplary embodiments of the present disclosure are denoted with the same reference symbols in the drawings. A summary of the reference symbols is provided in the list of reference symbols below.

DETAILED DESCRIPTION

Figure 1A:
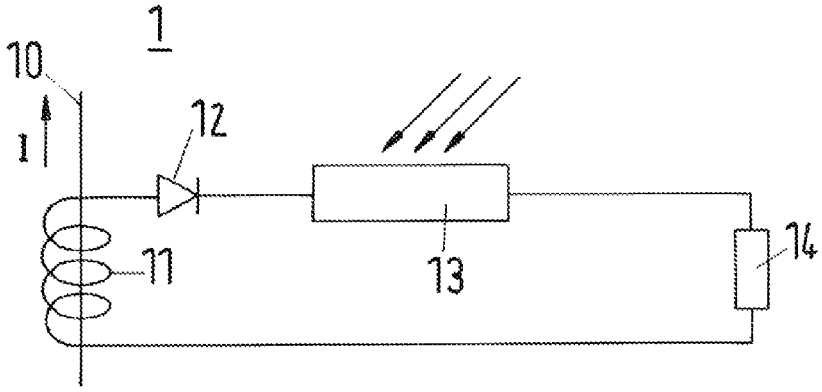
FIG. 1A shows the main current path of a switchgear according to an exemplary embodiment of the present disclosure.

Exemplary embodiments of the present disclosure reduce the reaction and ignition time in case of the occurrence of a light arc in a medium voltage switchgear.

In accordance with an exemplary embodiment, the electrical circuit of an inductive current detection means is electrically connected in series with a light sensing switching path, and a current signal generated by the electrical circuit directly ignites the propellant chemical charge.

By this arrangement, a disturbing current increase will consequently be folded with the light detection of a disturbing light arc in a cumulative way.

If both technical conditions occur, it gives a signal of a disturbing light arc, which has to be eliminated as quick as possible by earthing.

It is known for both signals to be detected by separate sensors, and both sensor signals will be sampled in an electronic device. This causes reaction time slots in series, which have to be added, so that the final mechanical earthing movement will be delayed.

On the other hand, according to an exemplary embodiment of the present disclosure, a limited electronic device for generating a signal to ignite the drive will be used between the current transformer and the light sensor. For example, a sensor with an inductive coupling to the main current path of the power path, generates a current in a circuit, which will be connected in series with the light arc sensor, in that way, that the light arc sensor becomes conductive in the moment of light exposure. As a result, the inductive, fault current induced current signal will flow over the momentary conductive light arc sensor and ignite directly the propellant charge. This is performed without any additional electronic device and thus there is no need for an auxiliary voltage. Thus, the drive will react very fast in case of occurring fault or disturbance current. To provide more power within the limited electronic device, all three current transformers can be used to supply the energy inside these device to ignite the micro gas generator at the same time. This may be provided if it is intended for the reaction time to not be selective for each phase. In the case of selective need, the device can be driven per each phase.

In accordance with an exemplary embodiment, the switchgear is or can contain an ultra fast earthing switch or a fast reacting switch.

In accordance with an exemplary embodiment, a current limiting element (e.g., a limited electronic device) is applied between the coupling inductivity and the light sensing switch.

In accordance with an exemplary embodiment, the light sensing element can be a photoresistor or a photocell.

In accordance with an exemplary embodiment, the photoresistor or photocell can be in functional connection with a microswitch, or a relay, or semiconductor relay, such as a semiconductor relay with very short switching time in the range of 1 ms for a microswitch and below 50 μs for the semiconductor relay.

In accordance with an exemplary embodiment of the present disclosure, of the switchgear can have a switchgear housing with several separated and not separated compartments. The arrangement of the electrical circuit of an inductive current detection means in series connection with the light sensing switching path is arranged in each compartment.

In accordance with an exemplary embodiment, the limited electronic device can be connected to one current transformer for generating electrical power for igniting one micro gas generators or fast acting switch at the same time to obtain selectivity for each phase.

In accordance with an exemplary embodiment, the limited electronic device can be connected to all three current transformer phases for generating electrical power for igniting all three micro gas generators or fast acting switch at the same time.

FIG. 1A shows the main current path 10 of a switchgear according to an exemplary embodiment of the present disclosure. A sensor arrangement 1 includes the components shown in FIG. 1A.

The inductive sensor element 11 detects a disturbing current (e.g., a threshold value caused by the occurrence of an internal arc) and reacts by the induction of a current sensor in the sensor arrangement 1. A diode 12 will limit this induced sensor current as a logic threshold element. This is electrically in series with a light sensor 13. Also in series is the micro gas generator 14 with a propellant charge or a fast reaction switch. The propellant charge will move the drive of an ultrafast earthing switch.

Figure 1B:
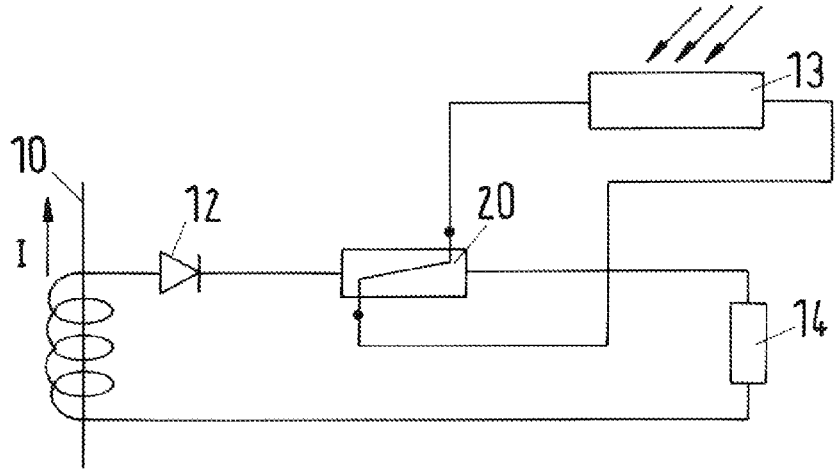
FIG. 1B shows the main current path of a switchgear having a relay according to an exemplary embodiment of the present disclosure.

FIG. 1B shows the use of a relay 20 which switches a circuit in series with the light sensor 13. The other components are the same as in FIG. 1A.

Figure 1C:
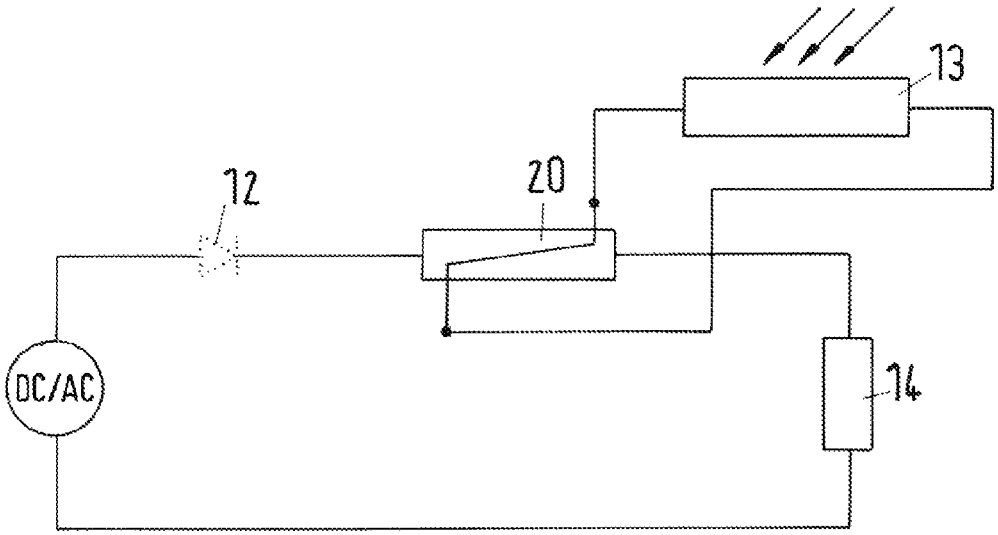
FIG. 1C shows the main current path of a switchgear with a separate DC/AC power source.

FIG. 1C shows an exemplary embodiment which includes a separate DC/AC source. The principle is the same.

Figure 2:
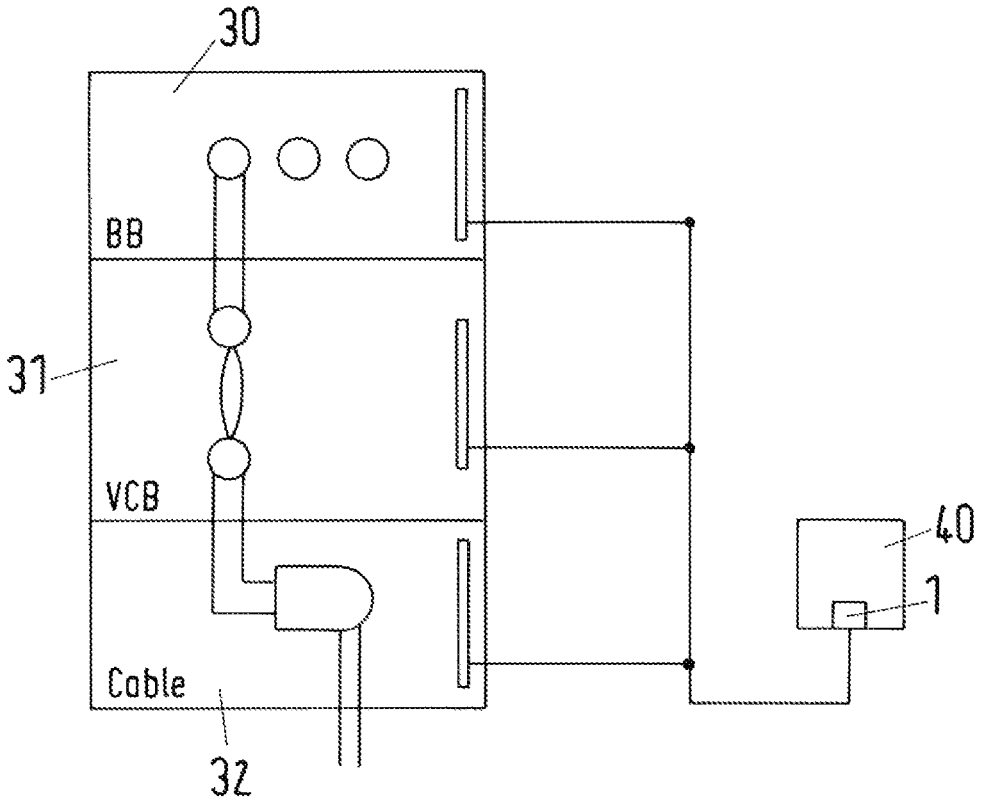
FIG. 2 is a block diagram of a housing of a switchgear according to an exemplary embodiment of the present disclosure.

FIG. 2 shows a housing of a switchgear with three inner compartments 30, 31, 32 which are applied with the sensor arrangement, so that in each compartment a disturbance or fault light arc can be detected very fast and generate the ultra fast earthing switch 40 in each case.

Several compartments are arranged in the housing. One compartment 30 contains the busbars, one compartment 31 contains the vacuum circuit breakers, and one compartment 32 contains the cables.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SYMBOLS

1 sensor arrangement with propellant charge
10 main circuit path
11 inductive sensor element
12 limiting diode
13 light sensor
14 micro gas generator
20 relay
30 compartment
31 compartment including a vacuum circuit breaker
32 compartment including a cable
40 ultra fast earthing switch

What is claimed is:

1. A switchgear comprising:

a switching device, which is configured to be driven by at least one of a propellant chemical charge and a fast acting switch;

detection means for detecting at least one of current and fault current;

optical sensor means including a light sensing switch having a light sensing switching path for detecting at least one of a light arc and fault light; and an inductive current detection means having an electrical circuit being electrically connected in series with the light sensing switching path of the optical sensor means, the electrical circuit being configured to generate a current signal to directly ignite the at least one of the propellant chemical charge and fast acting switch.

2. The switchgear according to claim 1, comprising:

an ultra fast earthing switch.

3. The switchgear according to claim 1, comprising:

a fast reacting switch.

4. The switchgear according to claim 1, comprising:

a current limiting element arranged between coupling inductivity of the inductive current detection means and the light sensing switch, the current limiting element being configured to apply a limited current without the need of an auxiliary voltage.

5. The switchgear according to claim 1, wherein the light sensing element includes one of a photoresistor and a photocell.

6. The switchgear according to claim 5, wherein the one of the photoresistor and photocell is in functional connection with one of a microswitch, a relay, and a semiconductor relay.

7. The switchgear according to claim 1, comprising:

a switchgear housing having several separated and not separated compartments, wherein the arrangement of the electrical circuit of the inductive current detection in series with the light sensing switching path is arranged in each compartment.

8. The switchgear according to claim 4, wherein the limited electronic device is connected to one current transformer for generating electrical power for igniting one micro gas generator or the fast acting switch at the same time to obtain selectivity for each phase.

9. The switchgear according to claim 4, wherein the limited electronic device is connected to all three current transformer phases for generating electrical power for igniting three micro gas generators or fast acting switches at the same time.

10. The switchgear according to claim 2, comprising:

a current limiting element arranged between coupling inductivity of the inductive current detection means and the light sensing switch, the current limiting element being configured to apply a limited electronic device without the need of an auxiliary voltage.

11. The switchgear according to claim 10, wherein the limited electronic device is connected to one current transformer for generating electrical power for igniting one micro gas generator or the fast acting switch at the same time to obtain selectivity for each phase.

12. The switchgear according to claim 11, comprising:

a switchgear housing having several separated and not separated compartments, wherein the arrangement of the electrical circuit of the inductive current detection in series with the light sensing switching path is arranged in each compartment.

13. The switchgear according to claim 10, wherein the limited electronic device is connected to all three current transformer phases for generating electrical power for igniting three micro gas generators or fast acting switches at the same time.

14. The switchgear according to claim 13, comprising:

a switchgear housing having several separated and not separated compartments, wherein the arrangement of the electrical circuit of the inductive current detection in series with the light sensing switching path is arranged in each compartment.

15. The switchgear according to claim 2, wherein the light sensing element includes one of a photoresistor and a photocell.

16. The switchgear according to claim 15, wherein the one of the photoresistor and photocell is in functional connection with one of a microswitch, a relay, and a semiconductor relay.

17. The switchgear according to claim 2, comprising:

a switchgear housing having several separated and not separated compartments, wherein the arrangement of the electrical circuit of the inductive current detection in series with the light sensing switching path is arranged in each compartment.

* * * * *